US008805230B2

(12) United States Patent
Momose et al.

(10) Patent No.: US 8,805,230 B2
(45) Date of Patent: Aug. 12, 2014

(54) IMAGE FORMING APPARATUS

(71) Applicant: Sharp Kabushiki Kaisha, Osaka (JP)

(72) Inventors: Norihide Momose, Osaka (JP); Kenji Sugimura, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 22 days.

(21) Appl. No.: 13/683,205

(22) Filed: Nov. 21, 2012

(65) Prior Publication Data

US 2013/0129369 A1 May 23, 2013

(30) Foreign Application Priority Data

Nov. 21, 2011 (JP) ..... 2011-253409

(51) Int. Cl.
*G03G 15/00* (2006.01)
*G03G 15/06* (2006.01)
*G03G 13/02* (2006.01)

(52) U.S. Cl.
CPC ..... *G03G 13/02* (2013.01); *G03G 15/065* (2013.01)
USPC ..... 399/88; 399/36; 399/90

(58) Field of Classification Search
CPC ... G03G 21/00; G03G 21/1638; G03G 13/08; G03G 13/06; G03G 15/50; G03G 15/5004; G03G 15/5012; G03G 15/5008; G03G 15/80; G03G 15/00; G03G 15/08; G03G 15/01; G03G 15/105; G03G 15/0121; G03G 15/0126; G03G 15/0266; G03G 15/02
USPC ..... 399/3, 21, 55, 87–90, 190, 234, 235, 399/228, 246, 285
See application file for complete search history.

(56) References Cited

U.S. PATENT DOCUMENTS

| | | | | |
|---|---|---|---|---|
| 4,192,604 | A * | 3/1980 | Koyama | 399/235 |
| 4,984,022 | A * | 1/1991 | Matsushita et al. | 399/235 |
| 5,003,353 | A * | 3/1991 | Nitta | 399/235 |
| 7,460,808 | B2 * | 12/2008 | Okada | 399/88 |
| 7,949,885 | B2 * | 5/2011 | Kikuchi et al. | 713/300 |

FOREIGN PATENT DOCUMENTS

| | | |
|---|---|---|
| JP | 08-146731 | 6/1996 |
| JP | 2002-196549 | 7/2002 |

* cited by examiner

*Primary Examiner* — Clayton E Laballe
*Assistant Examiner* — Ruifeng Pu
(74) *Attorney, Agent, or Firm* — Nixon & Vanderhye, P.C.

(57) ABSTRACT

An image forming apparatus is provided with a high-voltage substrate, a motor and a DC power source. The high-voltage substrate has a developing positive bias circuit and a developing reverse bias circuit which are connected to each other in parallel, in which the developing positive bias voltage is combined with developing reverse bias voltage to generate developing bias voltage. The high-voltage substrate includes a interruption switch for interrupting a reverse current from the motor to the developing reverse bias circuit in a case where an interlock switch is turned off at the time of emergency stop, in which, when the reverse current is interrupted by the interruption switch, electric power that is accumulated in the capacitor is supplied to the developing positive bias circuit to apply the developing positive bias voltage as the developing bias voltage to the developing roller for a given length of time.

5 Claims, 7 Drawing Sheets

IMAGE FORMING APPARATUS

CROSS-NOTING PARAGRAPH

This non-provisional application claims priority under 35 U.S.C. §119(a) on Patent Application No. 2011-253409 filed in JAPAN on Nov. 21, 2011, the entire contents of which are hereby incorporated herein by reference.

FIELD OF THE INVENTION

The present invention relates to an image forming apparatus, and more particularly to an image forming apparatus provided with an interlock mechanism that is operated at the time of emergency stop.

BACKGROUND OF THE INVENTION

Conventionally, in an image forming apparatus, for example, a DC power source is incorporated for outputting a direct current in two systems of 5 VDC and 24 VDC. Normally, 5 VDC is supplied to a control-type logic portion, while 24 VDC is supplied to a drive system high-current consumption portion such as a motor. Some of the image forming apparatuses are provided with a so-called interlock mechanism (interlock switch) for mechanically shutting off a 24 VDC power source of a motor, a high-voltage circuit and the like so as to prevent a user from being injured when the user opens an exterior cover of the image forming apparatus in order to deal with troubles such as paper jam. Thereby, when the exterior cover is opened, for example, an interlock switch is opened in conjunction therewith, and power supply to a load that is connected to a subsequent stage side of the interlock switch is interrupted.

FIG. 5 is a diagram showing a main part of an image forming apparatus provided with a conventional interlock mechanism. In the diagram, 101 denotes a 24 VDC power source (simply referred to as DC power source); 102 denotes an interlock switch; 103 denotes a motor; 104 denotes a high-voltage substrate; 105 denotes a photoreceptor drum; 106 denotes a developing roller; and 107 denotes a charger. Further, the high-voltage substrate 104 includes a diode 104*a*, a capacitor 104*b*, a developing positive bias circuit 104*c*, and a developing reverse bias circuit 104*d*.

FIG. 6A to FIG. 6C are diagrams for explaining a status of developing bias voltage at the time of starting printing in the image forming apparatus of FIG. 5. The high-voltage substrate 104 is configured by connecting the developing positive bias circuit 104*c* to the developing reverse bias circuit 104*d* in parallel. The developing positive bias circuit 104*c* generates predetermined developing positive bias voltage, and the developing reverse bias circuit 104*d* generates predetermined reverse bias voltage. Additionally, the high-voltage substrate 104 generates developing bias voltage by combining developing positive bias voltage with developing reverse bias voltage to apply the generated developing bias voltage to the developing roller 106.

For example, as shown in FIG. 6A, in the case of requiring "−450 V" as developing bias voltage, in the high-voltage substrate 104, "−550 V" in the developing positive bias circuit 104*c* and "+100 V" in the developing reverse bias circuit 104*d* are generated, those of which are combined to generate "−450 V" as the developing bias voltage. Here, in FIG. 6B, at the time of stoppage, the surface of the photoreceptor drum 105 is not charged, surface potential of which becomes "0 V". Then, at the time of starting printing, the photoreceptor drum 105, the charger 107 and the developing roller 106 are electrified, and when the photoreceptor drum 105 starts to rotate in an arrow direction, a left part of an X point of the photoreceptor drum 105 becomes charged to "−640 V" by the charger 107, however, charging is not applied between the X point and a Y point, and surface potential of an X-Y part thus remains in "0 V". Therefore, to the X-Y part passing through the developing roller 106, a toner with negative polarity is forcibly attached.

On the other hand, as shown in FIG. 6C, a pre-rotation processing is performed before starting printing to prevent a toner from being attached to the X-Y part. That is, while the X-Y part of the photoreceptor drum 105 passes through the developing roller 106 from the start of rotation of the photoreceptor drum 105, developing reverse bias voltage of "+100 V" is applied to the developing roller 106 as developing bias voltage (development actual high-voltage output). Thereby, the toner with negative polarity is attracted to the developing roller 106 side for preventing a toner from being attached to the X-Y part of the photoreceptor drum 105. This is a technique which is generally performed in a color copier for which two-component developer (toner or carrier) is mainly used.

Here, two-component developer is composed of a toner having a non-magnetic body and a carrier having a magnetic body. A main component of the carrier is iron, and held on the developing roller 106 by magnetic force of the developing roller 106 as a magnet roller, electrically having polarity (+) opposite to that of developing bias voltage. Thus, there is no problem in a case where surface potential of the photoreceptor drum 105 is −640 V and developing bias voltage is −450 V, however, when a potential difference thereof becomes large, electric force becomes greater than magnetic force, so that a carrier is attached onto the photoreceptor drum 105, which poses a problem.

For example, FIG. 6B assumingly shows a case where emergency stop is performed during printing, and the interlock switch 102 (FIG. 5) is turned off. At the time, in the photoreceptor drum 105, the X point is assumed to be in a position of the charger 107, and the Y point is assumed to be in a position of the developing roller 106. In this case, the X-Y part of the photoreceptor drum 105 is charged to "−640 V" by the charger 107. Then, the interlock switch 102 is turned off, whereby the developing roller 106 is stopped, so that developing bias voltage becomes 0 V. On the other hand, the photoreceptor drum 105 rotates through inertia even after emergency stop, and the X-Y part of the photoreceptor drum 105 passes through the developing roller 106. At the time, developing bias voltage of the developing roller 106 is "0 V", and surface potential of the X-Y part of the photoreceptor drum 105 is "−640 V". Therefore, a potential difference becomes large, and electric force becomes greater than magnetic force, so that a carrier is attached onto the photoreceptor drum 105.

On the other hand, for example, Japanese Laid-Open Patent Publication No. 2002-196549 describes a technique for changing in a phased manner developing bias voltage in order to prevent a carrier from moving from a developing sleeve to a photoreceptor side at the time of emergency stop due to paper jam during image forming operation, opening of a door by a user, and the like.

As shown in FIG. 5 described above, the capacitor 104*b* is provided in the high-voltage substrate 104 so as to be able to output "−450 V" as developing bias voltage by electric power accumulated in the capacitor 104*b* in which the photoreceptor drum 105 rotates through inertia after the interlock switch 102 is turned off due to emergency stop for a given length of time. Thereby, a potential difference between developing bias voltage of the developing roller 106 and surface potential of the X-Y part of the photoreceptor drum 105 is made smaller, so that a carrier is prevented from being attached to the drum while the drum rotates through inertia.

However, in FIG. 5, in a case where a plurality of loads such as the high-voltage substrate 104 and the motor 103 are connected to the DC power source 101, a counter electromotive current is generated by inertial rotation of the motor 103 at the time of emergency stop, which comes around the inside of the high-voltage substrate 104 in some cases. This case results in continuous driving of the developing reverse bias circuit 104*d* which is a circuit part unnecessary for the high-voltage substrate 104 by the counter electromotive current, so that charged voltage of the capacitor 104*b* is consumed in both the developing positive bias circuit 104*c* and the developing reverse bias circuit 104*d*. Thus, it is difficult to sufficiently secure an output holding time of developing bias voltage (developer holding time) so that a capacitor having large capacity is needed for sufficiently securing the developer holding time.

The image forming apparatus described in the above-described. Japanese Laid-Open Patent Publication. No. 2002-196549 is configured to change developing bias voltage in a phased manner in order to prevent a carrier from moving from a developing roller to a photoreceptor drum side, however, not intended to disclose a developing positive bias circuit and a developing reverse bias circuit, nor to solve the above-described problem.

SUMMARY OF THE INVENTION

An object of the present invention is to provide an image forming apparatus which is configured to be able to supply electric power that is accumulated in a capacitor only to a necessary circuit in a case where interlock is turned off at the time of emergency stop so as to allow an output holding time of developing bias voltage (developer holding time) to be made longer.

An object of the present invention is to provide an image forming apparatus, comprising: a developing portion that supplies a toner to a photoreceptor drum on which an electrostatic latent image is formed to visualize the electrostatic latent image; a high-voltage substrate that applies developing bias voltage to the developing portion; a drive system load that is connected to the high-voltage substrate in parallel; and a drive system power source that is connected to the high-voltage substrate and the drive system load via an interlock portion for supplying electric power to the high-voltage substrate and the drive system load, wherein the high-voltage substrate is provided with a developing positive bias circuit for generating developing positive bias voltage; a developing reverse bias circuit for generating developing reverse bias voltage; and a capacitor that is equipped in a pre-stage of the developing positive bias circuit, and the developing positive bias circuit is connected to the developing reverse bias circuit in parallel, and the developing positive bias voltage is combined with the developing reverse bias voltage to generate the developing bias voltage, and the high-voltage substrate also includes an interruption portion for interrupting a reverse current from the drive system load to the developing reverse bias circuit in a case where the interlock portion is turned off at the time of emergency stop, and when the reverse current is interrupted by the interruption portion, supplies electric power that is accumulated in the capacitor to the developing positive bias circuit and applies the developing positive bias voltage that is generated in the developing positive bias circuit as the developing bias voltage to the developing portion for a given length of time.

Another object of the present invention is to provide the image forming apparatus as defined in claim 1, wherein the drive system load is a motor, and the reverse current is generated by inertial rotation of the motor in a case where the interlock portion is turned off at the time of emergency stop.

Another object of the present invention is to provide the image forming apparatus as defined in claim 1, wherein the interruption portion is a switch that is equipped in a stage prior to the developing reverse bias circuit, and the switch is capable of connecting or disconnecting between the drive system power source and the developing reverse bias circuit.

Another object of the present invention is to provide the image forming apparatus as defined in claim 3, wherein a control portion is provided for turning off the switch in a case where the interlock portion is turned off at the time of emergency stop.

Another object of the present invention is to provide the image forming apparatus as defined in claim 3, wherein the switch is turned off in the high-voltage substrate in a case where the interlock portion is turned off at the time of emergency stop.

PREFERRED EMBODIMENTS OF THE INVENTION

Hereinafter, preferred embodiments according to an image forming apparatus of the present invention will be described with reference to accompanying drawings.

Figure 1:
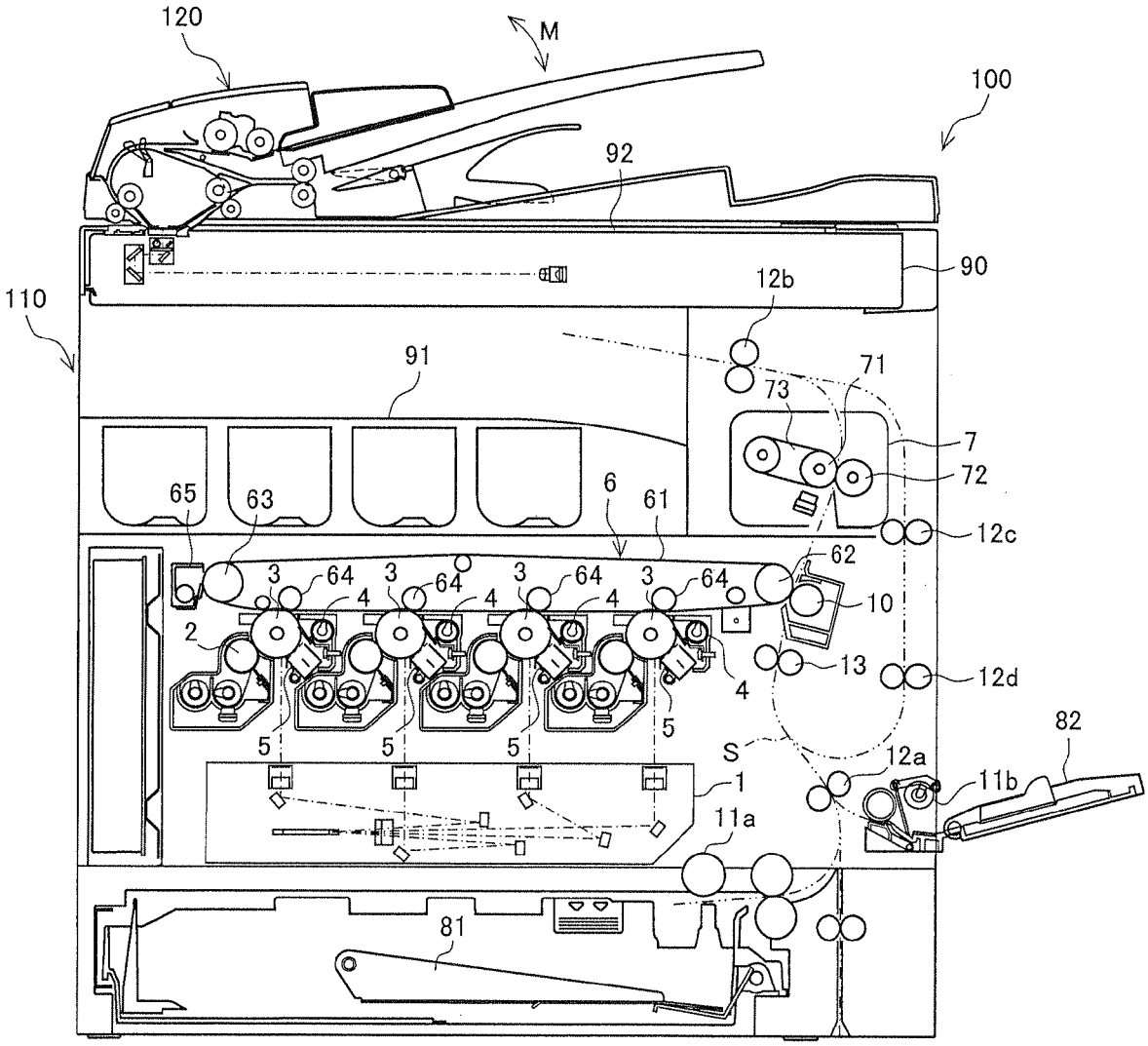
FIG. 1 is a diagram showing a configuration example of an image forming apparatus according to the present invention.

FIG. 1 is a diagram showing a configuration example of an image forming apparatus according to the present invention. An image forming apparatus 100 forms multicolor and unicolor images on a predetermined sheet (recording paper) corresponding to image data that is transferred from the outside, and is comprised of an apparatus body 110 and an automatic document processing device 120. The apparatus body 110 is comprised of an exposure unit 1, developing equipment (developing roller) 2, a photoreceptor drum 3, a cleaner unit 4, a charger 5, an intermediate transfer belt unit 6, a fixing unit 7, a paper feeding cassette 81, and a paper discharge tray 91.

A document platen 92 made of transparent glass is equipped in an upper part of the apparatus body 110, and a document is placed on the platen, the automatic document processing device 120 is mounted on an upper side of the document platen 92. The automatic document processing device 120 automatically feeds a document onto the document platen 92. Additionally, the automatic document processing device 120 is configured so as to rotate freely in the direction of an arrow M, and the top of the document platen 92 is opened so that it is possible to place a document by hand.

Image data which is processed in the image forming apparatus 100 corresponds to a color image using respective colors of black (K), cyan (C), magenta (M) and yellow (Y). Accordingly, four pieces each of the developing equipment 2, the photoreceptor drum 3, the charger 5 and the cleaner unit 4 are equipped so as to form four types of latent images corresponding to each of the colors, and set to black, cyan, magenta and yellow, respectively, and thereby four image stations are constituted.

The charger 5 is a charging portion for uniformly charging the surface of the photoreceptor drum 3 to predetermined potential, and for which, a contact-type roller type or brush type of a charger is used in addition to a charger type thereof as shown in FIG. 1 in some cases.

The exposure unit 1 is configured as a laser scanning unit (LSU) provided with a laser emission portion, a reflective mirror and the like. In the exposure unit 1, a polygon mirror that scans by a laser beam, and optical elements such as a lens and a mirror for guiding a laser beam that is reflected by the polygon mirror to the photoreceptor drum 3 are arranged. For the exposure unit 1, it is also possible to employ a method of using, for example, EL and LED writing heads in which light-emitting devices are arranged in an array.

The exposure unit 1 includes a function that exposes the charged photoreceptor drum 3 corresponding to input image data, thereby, on which surface, forming an electrostatic latent image corresponding to the image data. The developing equipment 2 visualizes the electrostatic latent image that is formed on each of the photoreceptor drums 3 with toners in four colors (Y, M, C and K). Further, the cleaner unit 4 removes/collects a toner which remains on the surface of the photoreceptor drum 3 after development and image transfer.

The intermediate transfer belt unit 6 that is arranged on an upper side of the photoreceptor drum 3 is provided with an intermediate transfer belt 61, an intermediate transfer belt driving roller 62, an intermediate transfer belt driven roller 63, an intermediate transfer roller 64 and an intermediate transfer belt cleaning unit 65. Four intermediate transfer rollers 64 described above are provided corresponding to each color for Y, M, C and K. The intermediate transfer belt 61 is stretched out among and rotationally driven by the intermediate transfer belt driving roller 62, the intermediate transfer belt driven roller 63 and the intermediate transfer roller 64. Furthermore, each intermediate transfer roller 64 imparts transfer bias for transferring a toner image of the photoreceptor drum 3 onto the intermediate transfer belt 61.

The intermediate transfer belt 61 is arranged to get into touch with each photoreceptor drum 3, and has a function that sequentially superimposes and transfers onto the intermediate transfer belt 61 toner images in respective colors that are formed on the photoreceptor drum 3, thereby forming a color toner image (multicolor toner image) on the intermediate transfer belt 61. The intermediate transfer belt 61 is formed in an endless shape with use of, for example, a film with thickness of about 100 μm to 150 μm.

The toner image is transferred from the photoreceptor drum 3 to the intermediate transfer belt 61 by the intermediate transfer roller 64 in contact with a back side of the intermediate transfer belt 61. To the intermediate transfer roller 64, high-voltage transfer bias (high voltage with polarity (+) opposite to charging polarity (−) of a toner) is applied in order to transfer the toner image. The intermediate transfer roller 64 is a roller based on a metal (for example, stainless-steel) axis with a diameter of 8 to 10 mm, whose surface is covered with a conductive elastic material (for example, EPDM, urethane form or the like). Such a conductive elastic material allows high voltage to be uniformly applied to the intermediate transfer belt 61. In the present embodiment, as a transfer electrode, a roller shape is used, however, a brush type or the like is also usable otherwise.

An electrostatic image which is visualized on each photoreceptor drum 3 corresponding to each color phase as described above is layered on the intermediate transfer belt 61. Image information layered in this manner is transferred onto paper by a transfer roller 10 that is arranged in a contact position of a sheet and the intermediate transfer belt 61 by rotation of the intermediate transfer belt 61.

At the time, the intermediate transfer belt 61 is brought into pressure-contact with the transfer roller 10 by a predetermined nip, while voltage for transferring a toner onto a sheet is applied to the transfer roller 10 (high voltage of polarity (+) opposite to charging polarity (−) of a toner). Further, for the purpose of steadily obtaining the above-described nip by the transfer roller 10, a hard material (metal or the like) is used for either one of the transfer roller 10 or the intermediate transfer belt driving roller 62, and a soft material such as an elastic roller (an elastic rubber roller, a formable resin roller or the like) is used for the other.

Moreover, as described above, a configuration is provided for removing/collecting by the intermediate transfer belt cleaning unit 65 a toner which is attached to the intermediate transfer belt 61 by contact with the photoreceptor drum 3 or a toner which remains on the intermediate transfer belt 61 without being transferred onto paper by the transfer roller 10, because of causing generation of a mixed color of toners at next step. The intermediate transfer belt cleaning unit 65 is provided with, for example, a cleaning blade as a cleaning member in contact with the intermediate transfer belt 61, and the intermediate transfer belt 61 in contact with the cleaning blade is supported by the intermediate transfer belt driven roller 63 on the back side thereof.

The paper feeding cassette 81 is a tray for accumulating sheets (recording paper) to be used for image formation, and equipped on a lower side of the exposure unit 1 of the apparatus body 110. Additionally, the sheets to be used for image formation are able to be placed also in a manual paper feeding cassette 82. Further, the paper discharge tray 91 provided above the apparatus body 110 is a tray for piling up the printed sheets facedown.

Further, the apparatus body 110 is provided with a paper conveyance path S in an approximately vertical shape for feeding a sheet in the paper feeding cassette 81 and the manual paper feeding cassette 82 to the paper discharge tray 91 through the transfer roller 10 and the fixing unit 7. Near the paper conveyance path S from the paper feeding cassette 81 or the manual paper feeding cassette 82 to the paper discharge tray 91, pick-up rollers 11*a* and 11*b*, a plurality of conveying rollers 12*a* to 12*d*, a registration roller 13, the transfer roller 10, the fixing unit 7 and the like are arranged.

The conveying rollers 12*a* to 12*d* are small-size rollers for promoting and assisting conveyance of sheets, a plurality of which are equipped along the paper conveyance path S. Further, the pick-up roller 11*a* is equipped near the end of the paper feeding cassette 81, and picks a sheet up from the paper feeding cassette 81 sheet by sheet for supplying to the paper conveyance path S. Moreover, the pick-up roller 11*b* is provided near the end of the manual paper feeding cassette 82 as well, and picks a sheet up from the manual paper feeding cassette 82 sheet by sheet for supplying to the paper conveyance path S.

Furthermore, the registration roller 13 keeps once the sheet that is conveyed through the paper conveyance path S, and has a function that conveys the sheet to the transfer roller 10 at the time of matching a leading end of a toner image on the photoreceptor drum 3 to a leading end of the sheet.

The fixing unit 7 is provided, with a heat roller 71 and a pressurizing roller 72, in which the heat roller 71 and the pressurizing roller 72 are configured to rotate by holding a sheet therebetween. Additionally, the heat roller 71 is configured to have a predetermined fixing temperature by a control portion based on a signal from a not-shown temperature detector, and has a function that brings with the pressurizing roller 72 a toner into thermocompression bonding to a sheet, whereby a multicolor toner image that is transferred to the sheet is fused, mixed and brought into pressure-contact with respect to the sheet to be thermally fixed. Further, an outer heating belt 73 is equipped for heating the heat roller 71 from the outside.

A main object of the present invention is to allow electric power that is accumulated in a capacitor to be supplied only to a necessary circuit in a case where interlock is turned off at the time of emergency stop so as to make an output holding time of developing bias voltage (developer holding time) longer. An exemplary main configuration of the image forming apparatus will be described accordingly with reference to FIG. 2.

Figure 2:
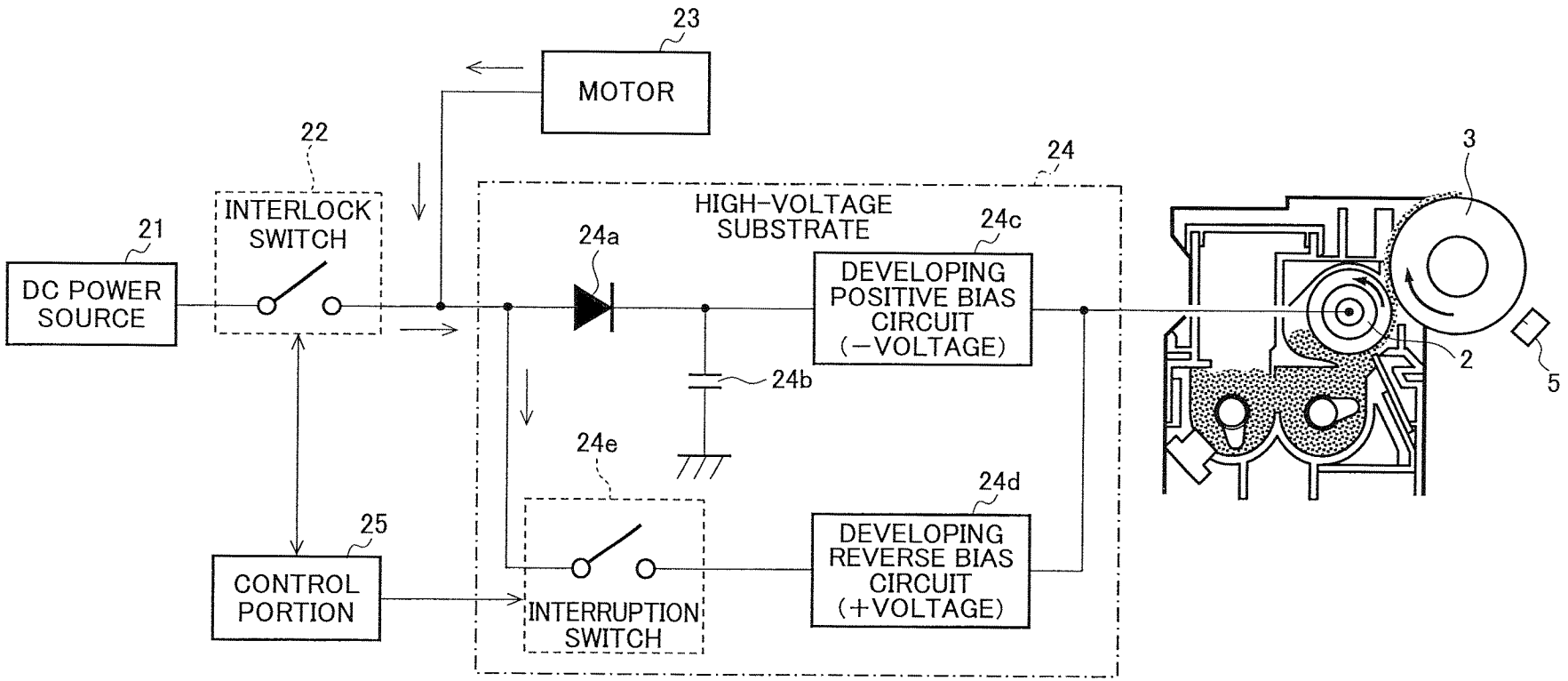
FIG. 2 is a diagram for explaining an exemplary main configuration of the image forming apparatus according to the present invention.

In FIG. 2, the image forming apparatus is provided with a developing roller 2 corresponding to a developing portion that imparts a toner to the photoreceptor drum 3 on which an electrostatic latent image is formed to visualize the electrostatic latent image; a high-voltage substrate 24 for applying developing bias voltage to the developing roller 2; a motor 23 that is an example of a drive system load that is connected to the high-voltage substrate 24 in parallel; and a DC power source 21 corresponding to a drive system power source that is connected to the high-voltage substrate 24 and the motor 23 via an interlock switch 22 (corresponding to an interlock portion) to supply electric power to the high-voltage substrate 24 and the motor 23. Note that, in the case of this example, the motor 23 is illustrated as a drive system load.

The high-voltage substrate 24 is provided with a diode 24*a*; a developing positive bias circuit 24*c* for generating developing positive bias voltage; a developing reverse bias circuit 24*d* for generating developing reverse bias voltage; and a capacitor 24*b* that is provided in a pre-stage of the developing positive bias circuit 24*c*, in which the developing positive bias circuit 24*c* is connected to the developing reverse bias circuit 24*d* in parallel to combine developing positive bias voltage with developing reverse bias voltage for generating developing bias voltage. Further, the high-voltage substrate 24 is provided with a interruption switch 24*e* as an example of a interruption portion for interrupting off a reverse current from the motor 23 to the developing reverse bias circuit 24*d*, in which electric power that is accumulated in the capacitor 24*b* is supplied to the developing positive bias circuit 24*c* when the reverse current is interrupted by the interruption switch 24*e* to apply the developing positive bias voltage that is generated in the developing positive bias circuit 24*c* as developing bias voltage to the developing roller 2 for a given length of time.

In an example of FIG. 2, the interruption switch 24*e* is a switch that is equipped in a stage prior to the developing reverse bias circuit 24*d* and is capable of connecting or disconnecting between the DC power source 21 and the developing reverse bias circuit 24*d*. Additionally, the interruption switch 24*e* is switched over by a control portion (corresponding to a control portion of the present invention) 25 or the high-voltage substrate 24.

The above-described reverse current is generated by inertial rotation of the motor 23 in a case where the interlock switch 22 is turned off at the time of emergency stop, however, it is possible to interrupt the reverse current from the motor 23 with the interruption switch 24*e* in a circuit configuration according to the present invention, thus not allowing the developing reverse bias circuit 24*d* to be driven by the reverse current. Therefore, electric power that is accumulated in the capacitor 24*b* is supplied only to the developing positive bias circuit 24*c* so that it is possible to apply a developing positive bias voltage (−550 V) that is generated in the developing positive bias circuit 24*c* as developing bias voltage to the developing roller 2 for a given length of time.

That is, it is possible to output "−550 V" as developing bias voltage by electric power that is accumulated in the capacitor 24*b* for a given length of time during which the photoreceptor drum 3 rotates through inertia after the interlock switch 22 is turned off due to emergency stop. This makes it possible to make a potential difference between developing bias voltage of the developing roller 2 and surface potential of the photoreceptor drum 3 smaller to prevent a carrier from being attached to the drum while the drum rotates through inertia. Additionally, a reverse current generated by inertial rotation of the motor 23 which flows into the developing reverse bias circuit 24*d* is able to be interrupted, thus making it possible to supply the electric power that is accumulated in the capacitor 24*b* only to the developing positive bias circuit 24*c* in the high-voltage substrate 24, so that it is possible to make an output holding time of developing bias voltage (developer holding time) longer. Further, in the case of making the developer holding time the same as that of a conventional apparatus (in a case where developer holding times T1 and T2 are the same as each other in examples of FIG. 4A and FIG. 4B described below), it is possible to reduce capacity of a capacitor compared to that of a conventional apparatus, thus making it possible to attempt to reduce cost.

Here, the image forming apparatus is provided with the control portion 25 for turning off the interruption switch 24*e* in a case where the interlock switch 22 is turned off at the time of emergency stop. The control portion 25 controls, when detecting via a sensor or the like that a front cover of the apparatus is opened during image forming operation, the interlock switch 22 to be turned off (opened) to stop power supply from the DC power source 21 to the motor 23 and the high-voltage substrate 24. Then, the control portion 25 controls, when detecting that the interlock switch 22 is turned off, the interruption switch 24*e* to be turned off (opened). Thereby, a reverse current caused by inertial rotation of the motor 23 which flows into the developing reverse bias circuit 24*d* is interrupted.

Note that, the interruption switch 24*e* may be controllably turned on/off in the high-voltage substrate 24. In this case, a control-oriented microcomputer is equipped inside the high-voltage substrate 24 to control the interruption switch 24*e* to be tuned off when the control-oriented microcomputer detects that the interlock switch 22 is turned off at the time of emergency stop.

Figure 3:
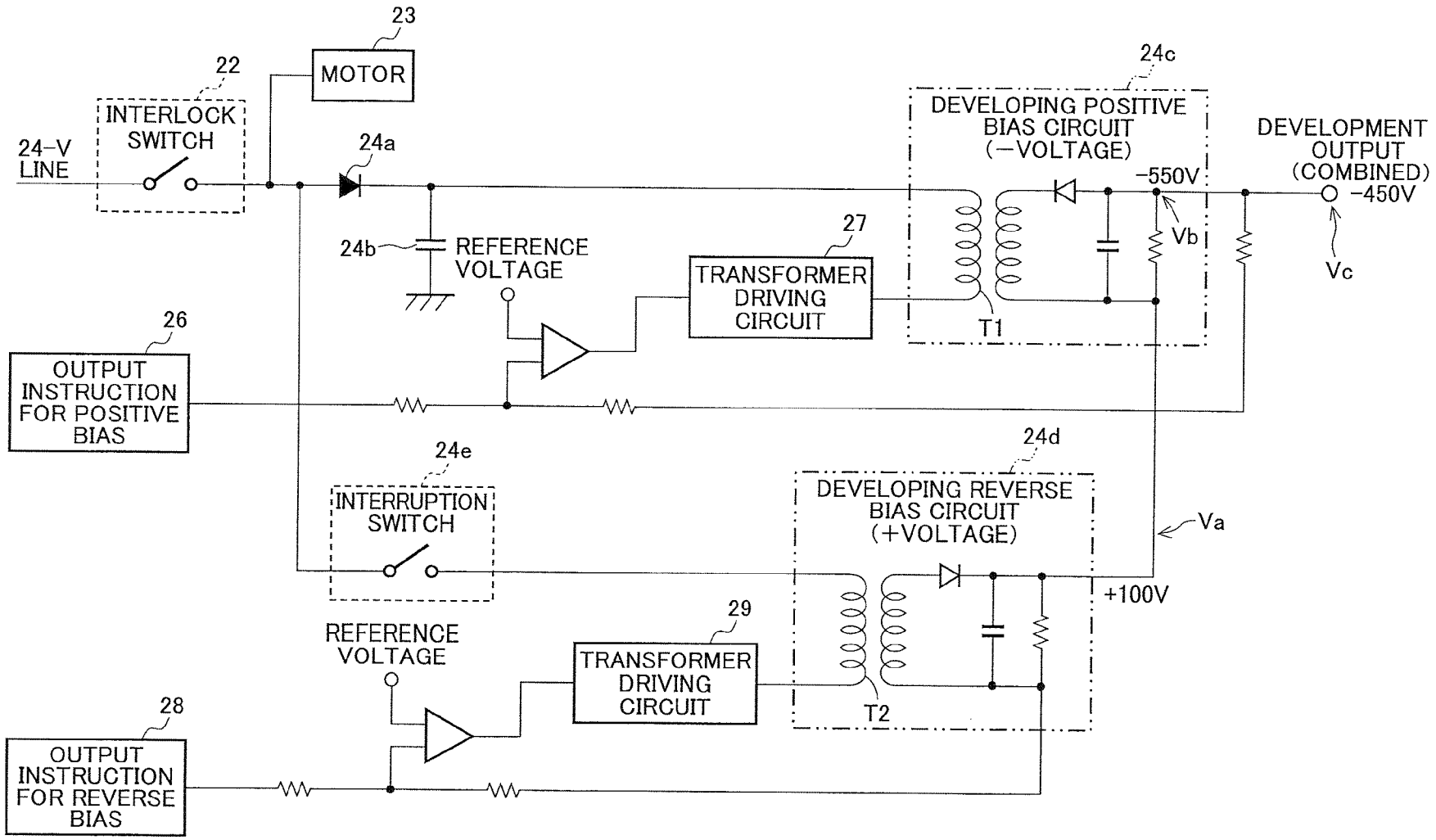
FIG. 3 is a diagram showing the exemplary main configuration of FIG. 2 as an electric circuit.

FIG. 3 is a diagram showing the main configuration of FIG. 2 as an electric circuit. The developing positive bias circuit 24*c* includes a developing positive bias transformer T1, in which a transformer driving circuit 27 is driven corresponding to an output instruction for positive bias 26 from the control portion 25 to generate developing positive bias voltage (+550 V) with the developing positive bias transformer T1. Similarly, the developing reverse bias circuit 24*d* includes a developing reverse bias transformer T2, in which a transformer driving circuit 29 is driven corresponding to an output instruction for reverse bias 28 from the control portion 25 to generate developing reverse bias voltage (−100 V) with the developing reverse bias transformer T2.

Normally, in order to generate "−450 V" in Vc as development output, the developing reverse bias transformer T2 is driven to generate "+100 V" in Va. Then, in order to keep Vc=−450 V (constant), the developing positive bias transformer T1 is driven to generate "−550 V" in Vb, A high-voltage circuit is controlled so that Vc voltage becomes "−450 V". Whereas, since the interlock switch 22 is turned off at the time of emergency stop, 24-V electric supply to both the transformers T1 and T2 is only performed with voltage that is charged in the capacitor 24*b* for holding developer. At the time, the interruption switch 24*e* prevents the developing reverse bias transformer T2 from being driven, so that all voltage charged in the capacitor 24*b* for holding developer is just consumed in the developing positive bias transformer T1. Furthermore, since the developing reverse bias transformer T2 is not driven, Va becomes 0 V, and "−450 V" only has to be generated in Vb for Vc=−450 V (constant). That is, Vb is stepped down from "−550 V" to "−450 V", so that power consumption in the developing positive bias transformer T1 becomes small. Thus, the time in which voltage that is charged in the capacitor 24*b* for holding developer is consumed becomes longer accordingly, resulting in longer developer holding time.

Figure 4A:
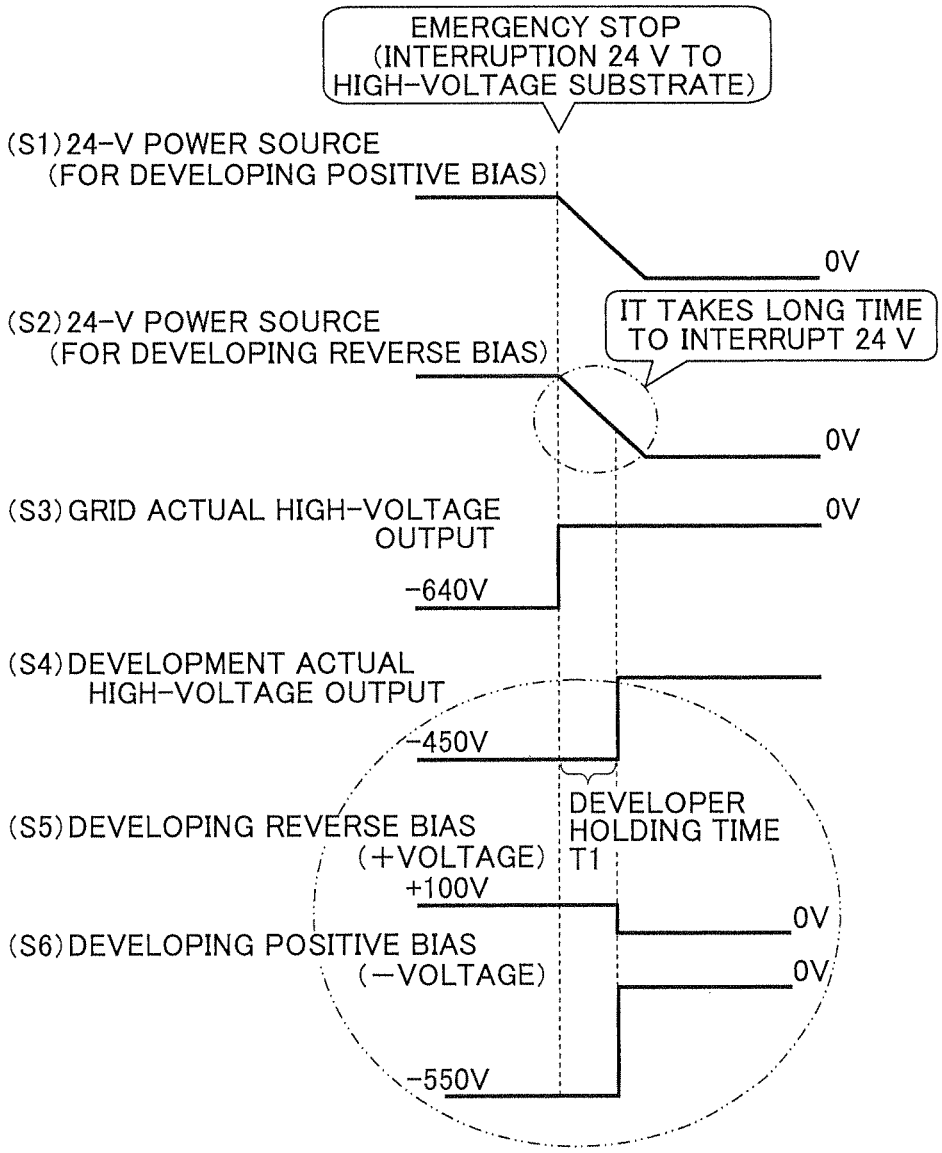
FIG. 4A and FIG. 4B are diagrams showing an example of a timing chart at the time of emergency stop by the image forming apparatus of the present invention.
Figure 4B:
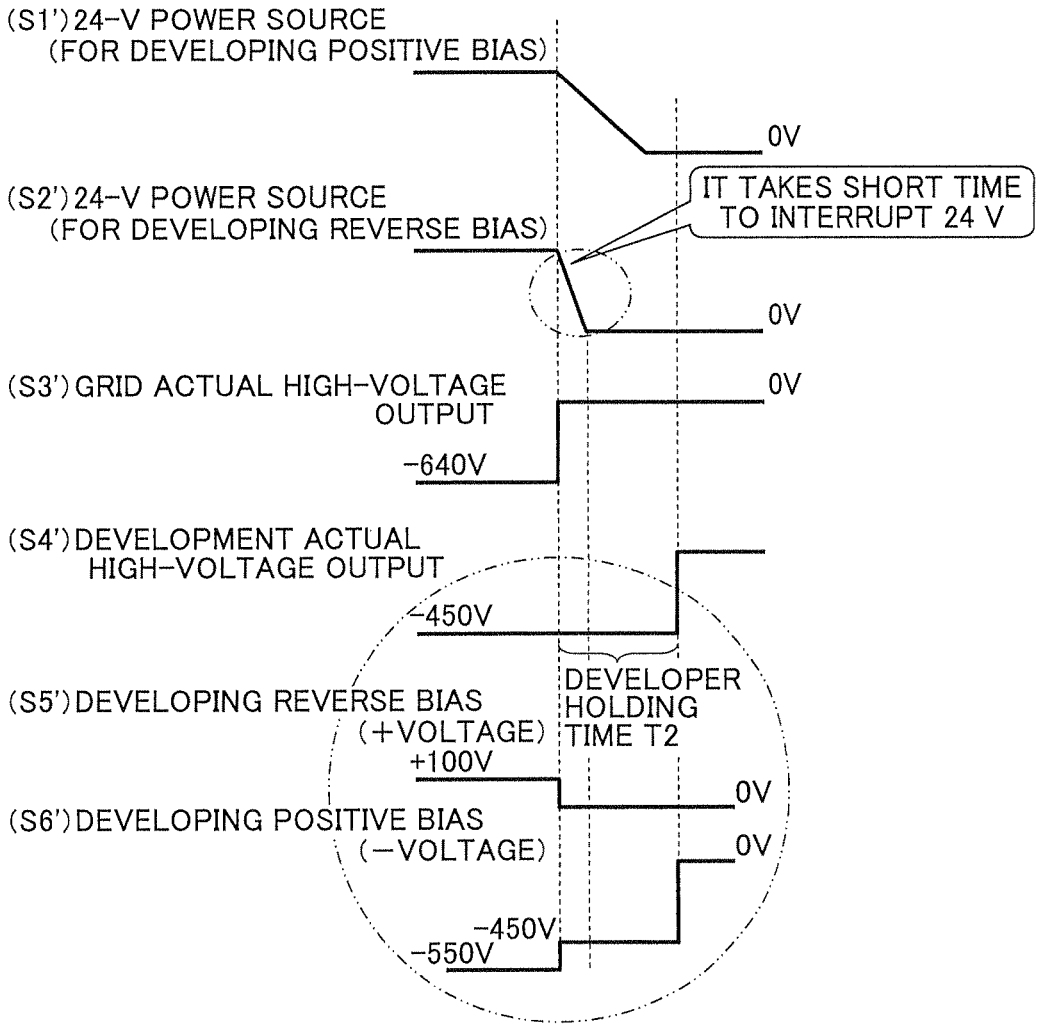

FIG. 4A and FIG. 4B is a diagram showing an example of a timing chart at the time of emergency stop by the image forming apparatus of the present invention. FIG. 4A shows a timing chart by a conventional image forming apparatus, and FIG. 4B shows a timing chart by the image forming apparatus of the present invention. Note that, in the diagram, a 24-V power source (for developing positive bias) indicates 24-V line signal voltage (−) to a developing positive bias circuit of a high-voltage substrate (S1, S1'), and a 24-V power source (for developing reverse bias) indicates 24-V line signal voltage (+) to a developing reverse bias circuit of a high-voltage substrate (S2, S2'). Further, grid actual high-voltage output indicates grid actual high-voltage output from a high-voltage substrate (−640 V in this example) (S3, S3'), and development actual high-voltage output indicates development actual high-voltage output (−450 V in this example) (S4, S4'). Moreover, developing reverse bias (+ voltage) indicates developing reverse bias output of a developing reverse bias circuit in a high-voltage substrate (+100 V in this example) (S5, S5'), and developing positive bias (− voltage) indicates developing positive bias output of a developing positive bias circuit in a high-voltage substrate (−550 V in this example) (S6, S6'). Note that, the development actual high-voltage output at S4 is obtained by combining the developing positive bias output at S5 with the developing reverse bias output at S6. Similarly, the development actual high-voltage output at S4' is obtained by combining the developing positive bias output at S5' with the developing reverse bias output at S6'.

In the above description, the grid actual high-voltage output is a voltage when the surface of a photoreceptor drum is charged by a charger, and the development actual high-voltage output is developing bias voltage that is applied to a developing roller.

Figure 5:
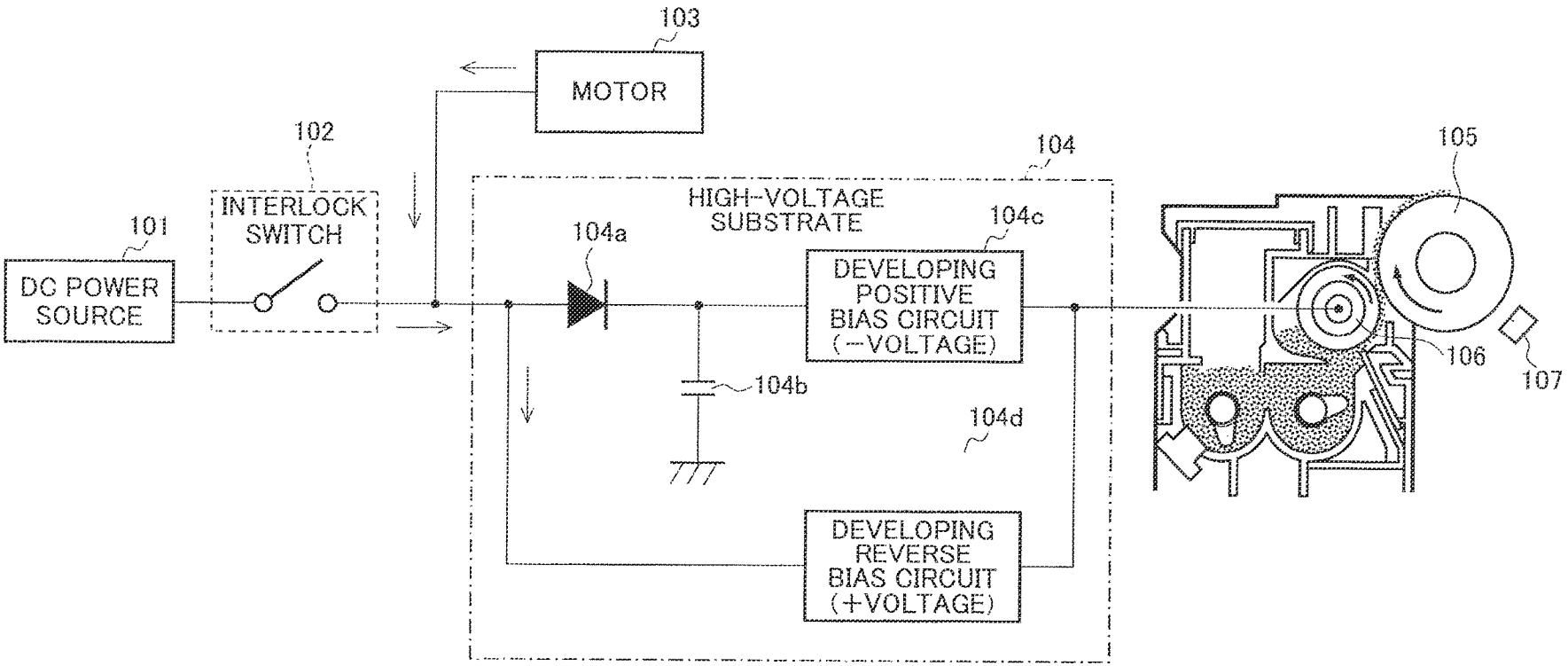
FIG. 5 PRIOR ART
FIG. 5 is a diagram showing a main part of an image forming apparatus provided with a conventional interlock mechanism.
Figure 6A:
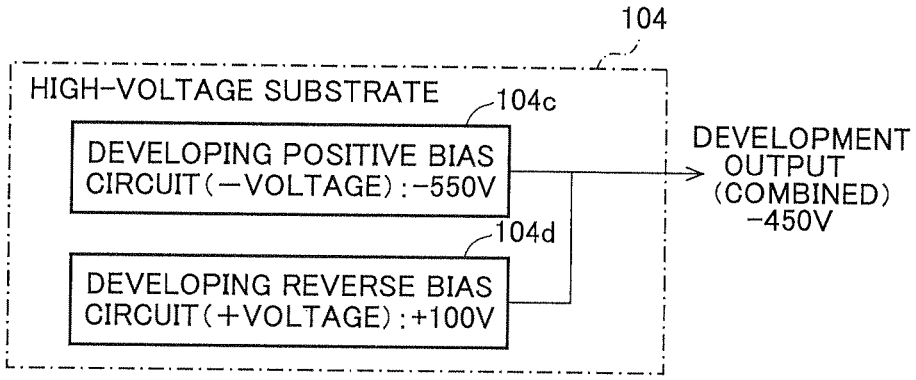
FIGS. 6A to 6C are diagrams for explaining a status of developing bias voltage at the time of starting printing in the image forming apparatus of FIG. 5.
Figure 6B:
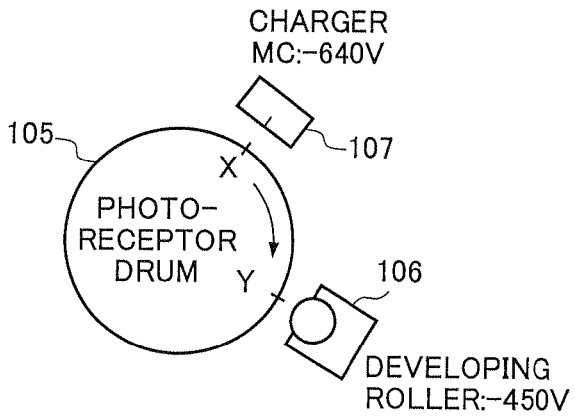
Figure 6C:
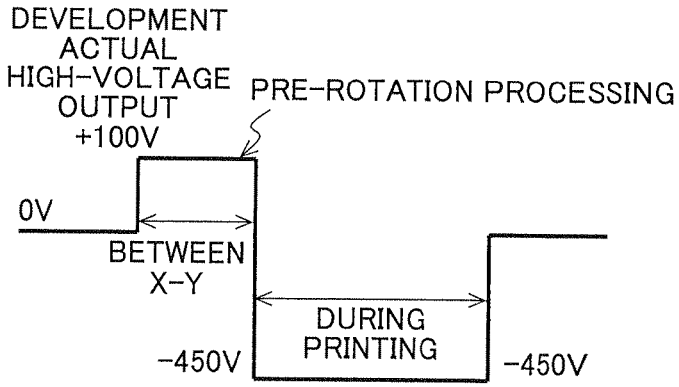

First, a conventional configuration will be described with reference to FIG. 4A and FIG. 5. At the time of emergency stop (the interlock switch 102 is turned off), 24 V is changed to 0 V at both S1 and S2, however, the 24-V line signal voltage (+) at S2 is not cut down immediately due to counter electromotive voltage caused by inertial rotation of the motor 103 so as to have gradual gradient. Then, in a case where the 24-V line signal voltage (+) at S2 is certain voltage (for example, 13 V) or more, not only the developing positive bias circuit 104*c* at S6 but also the developing reverse bias circuit 104*d* at S5 are continuously driven, and a developer holding time of the development actual high-voltage output at S4 as combined output thereof thus becomes T1. In the case of FIG. 4A, the developing reverse bias circuit 104*d* at S5 is operated, so that electric power that is accumulated in the capacitor 104*b* is consumed in both the developing positive bias circuit 104*c* and the developing reverse bias circuit 104*d*. Therefore, the developer holding time T1 becomes shorter compared to the developer holding time T2 in FIG. 4B.

The configuration of the present invention will be described with reference to FIG. 4B and FIG. 2. At the time of emergency stop (the interlock switch 22 is turned off), the 24-V line signal voltage (−) at S1' has gradual gradient as with S1, however, the 24-V line signal voltage (+) at S2' is immediately cut down from 24 V to 0 V with the interruption switch 24*e*, thus having sharp gradient compared to S2. Then, 24 V is immediately cut down at S2', and the developing positive bias circuit 24*c* at S6' is thus continuously driven at "−450 V", however, the developing reverse bias circuit 24*d* at S5' is interrupted immediately. Therefore, the developer holding time T2 of the development actual high-voltage output at S4' as combined output thereof becomes longer than the developer holding time T1 of the development actual high-voltage output at S4. In the case of FIG. 4B, the developing reverse bias circuit 24*d* at S5' is not operated, so that all electric power that is accumulated in the capacitor 24*b* is consumed in the developing positive bias circuit 24*c* at S6'. Thus, the developer holding time T2 becomes longer compared to the developer holding time T1 in FIG. 4A.

As a reason for the above description which is explained in FIG. 3 described above, the developing positive bias voltage Vb of the developing positive bias circuit 24*c* is stepped down from "−550 V" to "−450 V" so that power consumption in the developing positive bias transformer T1 becomes small. Thus, the time in which voltage that is charged in the capacitor 24*b* for holding developer is consumed becomes longer accordingly, resulting in longer developer holding time T2.

In this manner, according to the present invention, in a case where interlock is turned off at the time of emergency stop, a counter electromotive current generated by inertial rotation of a motor or the like which flows into a developing reverse bias circuit is allowed to be interrupted, and it is thus possible to supply electric power that is accumulated in a capacitor only to a necessary circuit (developing positive bias circuit) in a high-voltage substrate, so that it is possible to make an output holding time of developing bias voltage (developer holding time) longer. Additionally, in a case where the developer holding time is made the same as that of a conventional apparatus (in the case of the developing positive bias transformer T1=T2 in examples of FIG. 4A and FIG. 4B), it is possible to reduce capacity of a capacitor compared to that of a conventional apparatus, thus making it possible to attempt to reduce cost.

The invention claimed is:

1. An image forming apparatus, comprising:

a developing portion that supplies a toner to a photoreceptor drum on which an electrostatic latent image is formed to visualize the electrostatic latent image;

a high-voltage substrate that applies developing bias voltage to the developing portion;

a drive system load that is connected to the high-voltage substrate in parallel; and a drive system power source that is connected to the high-voltage substrate and the drive system load via an interlock portion for supplying electric power to the high-voltage substrate and the drive system load, wherein the high-voltage substrate is provided with a developing positive bias circuit for generating developing positive bias voltage; a developing reverse bias circuit for generating developing reverse bias voltage; and a capacitor that is equipped in a pre-stage of the developing positive bias circuit, and the developing positive bias circuit is connected to the developing reverse bias circuit in parallel, and the developing positive bias voltage is combined with the developing reverse bias voltage to generate the developing bias voltage, and the high-voltage substrate also includes an interruption portion for interrupting a reverse current from the drive system load to the developing reverse bias circuit in a case where the interlock portion is turned off at the time of emergency stop, and when the reverse current is interrupted by the interruption portion, supplies electric power that is accumulated in the capacitor to the developing positive bias circuit and applies the developing positive bias voltage that is generated in the developing positive bias circuit as the developing bias voltage to the developing portion for a given length of time.

2. The image forming apparatus as defined in claim 1, wherein the drive system load is a motor, and the reverse current is generated by inertial rotation of the motor in a case where the interlock portion is turned off at the time of emergency stop.

3. The image forming apparatus as defined in claim 1, wherein the interruption portion is a switch that is equipped in a stage prior to the developing reverse bias circuit, and the switch is capable of connecting or disconnecting between the drive system power source and the developing reverse bias circuit.

4. The image forming apparatus as defined in claim 3, wherein a control portion is provided for turning off the switch in a case where the interlock portion is turned off at the time of emergency stop.

5. The image forming apparatus as defined in claim 3, wherein the switch is turned off in the high-voltage substrate in a case where the interlock portion is turned off at the time of emergency stop.

* * * * *